US008336362B2

(12) United States Patent
Frenken

(10) Patent No.: US 8,336,362 B2
(45) Date of Patent: Dec. 25, 2012

(54) PAIR OF PRESSING JAWS FOR HYDRAULIC OR ELECTRIC PRESSING TOOL

(75) Inventor: Egbert Frenken, Heinsberg (DE)

(73) Assignee: Gustav Klauke GmbH (DE)

( * ) Notice: Subject to any disclaimer, the term of this patent is extended or adjusted under 35 U.S.C. 154(b) by 189 days.

(21) Appl. No.: 13/011,412

(22) Filed: Jan. 21, 2011

(65) Prior Publication Data

US 2011/0113851 A1 May 19, 2011

Related U.S. Application Data

(63) Continuation of application No. 11/850,504, filed on Sep. 5, 2007, now abandoned.

(30) Foreign Application Priority Data

Sep. 7, 2006 (DE) ..... 20 2006 013 693 U

(51) Int. Cl.
*B21D 37/12* (2006.01)

(52) U.S. Cl. ..... 72/416

(58) Field of Classification Search ..... 72/412, 72/416, 433, 434, 482.91; 81/321, 417, 427; 140/117, 123
See application file for complete search history.

(56) References Cited

U.S. PATENT DOCUMENTS

| | | | | |
|---|---|---|---|---|
| 878,493 | A | 2/1908 | Barnes | |
| 922,330 | A * | 5/1909 | Powell | 81/321 |
| 1,619,137 | A | 3/1927 | Knott | |
| 1,743,209 | A | 1/1930 | Groehn | |
| 2,396,562 | A | 3/1946 | Forss | |
| 2,595,989 | A | 5/1952 | Smeltz | |
| 2,600,860 | A | 6/1952 | Dupre | |
| 2,766,631 | A | 10/1956 | Van Sittert | |
| 2,979,032 | A | 4/1961 | Engquist et al. | |
| 3,026,646 | A | 3/1962 | Weaver | |
| 3,044,074 | A | 7/1962 | Tebb et al. | |
| 3,323,346 | A | 6/1967 | Spangler et al. | |
| 3,372,479 | A | 3/1968 | Fischer | |
| 3,427,837 | A | 2/1969 | Faulconer | |
| 3,626,445 | A | 12/1971 | Penix | |
| 3,717,744 | A | 2/1973 | Pishioneri | |

(Continued)

FOREIGN PATENT DOCUMENTS

DE 1812109 12/1968

(Continued)

*Primary Examiner* — Debra Sullivan
(74) *Attorney, Agent, or Firm* — Clark Hill PLC

(57) ABSTRACT

The invention relates to a pair of pressing jaws for hydraulic or electric pressing tools for pressing fittings onto pipes or for the press connection of electric cables, two pressing jaws connected to one another in an articulated manner forming a pair of pressing jaws, the pressing jaws being biased into their open position by a tension spring which spans a free space between the two pressing jaws, and in each case one end of the tension spring being accommodated in an accommodating opening which opens out into a narrow peripheral side of the pressing jaw, this narrow peripheral side being directed toward the free space, and, in order to secure the tension spring, a tension-spring end engaging around a pin-like securing part, which securing part is disposed at that end of the accommodating opening which is directed away from the free space. In order to secure the tension spring in a functionally advantageous manner, it is provided that the securing part is formed as an integral crosspiece of the pressing jaw.

9 Claims, 16 Drawing Sheets

U.S. PATENT DOCUMENTS

| | | | |
|---|---|---|---|
| 3,877,286 | A | 4/1975 | Fontaine et al. |
| 3,902,385 | A | 9/1975 | Haby |
| 4,026,028 | A | 5/1977 | Green |
| 4,169,652 | A | 10/1979 | Hockele et al. |
| 4,257,135 | A | 3/1981 | Moebius |
| 4,426,869 | A | 1/1984 | Farmer et al. |
| 4,607,548 | A | 8/1986 | Anderson |
| 4,760,644 | A | 8/1988 | Yirmiyahu et al. |
| 4,869,465 | A | 9/1989 | Yirmiyahu et al. |
| 4,956,992 | A | 9/1990 | Undin |
| 5,012,666 | A | 5/1991 | Chen et al. |
| 5,040,278 | A | 8/1991 | Eckold et al. |
| 5,105,543 | A | 4/1992 | Maarschalk et al. |
| 5,125,296 | A | 6/1992 | Nelson et al. |
| 5,138,862 | A | 8/1992 | Chasteen |
| 5,138,864 | A | 8/1992 | Tarpill |
| 5,243,883 | A | 9/1993 | Savage |
| 5,284,375 | A | 2/1994 | Land, III |
| 5,335,530 | A | 8/1994 | Homm |
| 5,487,297 | A | 1/1996 | Ryan et al. |
| 5,490,406 | A | 2/1996 | College |
| 5,934,136 | A | 8/1999 | Bracher et al. |
| 6,000,680 | A | 12/1999 | Kimura et al. |
| 6,035,775 | A | 3/2000 | Nghiem |
| 6,042,166 | A | 3/2000 | Conte |
| 6,044,686 | A | 4/2000 | Dischler |
| 6,244,085 | B1 | 6/2001 | Dummermuth |
| 6,434,998 | B2 | 8/2002 | Amherd |
| 6,457,338 | B1 | 10/2002 | Frenken |
| 6,510,723 | B2 | 1/2003 | Amherd |
| 6,513,198 | B2 | 2/2003 | Lu |
| 6,739,172 | B2 | 5/2004 | Wagner |
| 6,772,618 | B2 | 8/2004 | Frenken |
| 6,981,326 | B1 | 1/2006 | Huang |
| 7,000,448 | B2 | 2/2006 | Hamm et al. |
| 7,043,806 | B2 | 5/2006 | Schrock et al. |
| 7,055,414 | B2 | 6/2006 | Konen |
| 7,124,608 | B2 | 10/2006 | Goop |
| 7,155,955 | B2 | 1/2007 | Bowles et al. |
| 7,299,724 | B1 * | 11/2007 | Warheit ..... 81/409.5 |
| 2001/0027676 | A1 | 10/2001 | Frenken |
| 2005/0120770 | A1 | 6/2005 | Frenken |
| 2005/0241359 | A1 | 11/2005 | Viegener |
| 2006/0000072 | A1 | 1/2006 | Frenken |

FOREIGN PATENT DOCUMENTS

| | | | |
|---|---|---|---|
| DE | 29703053 | | 5/1997 |
| DE | 29718204 | | 1/1998 |
| DE | 20016060 | U1 | 12/2000 |
| DE | 20113238 | | 11/2001 |
| DE | 20213661 | | 11/2002 |
| DE | 10200258 | | 7/2003 |
| DE | 10318508 | | 8/2004 |
| DE | 10354307 | | 8/2004 |
| DE | 20318618 | U1 | 4/2005 |
| DE | 102004016110 | A1 | 10/2005 |
| DE | 102005028083 | | 2/2006 |
| DE | 102005028083 | A1 * | 2/2006 |
| EP | 389716 | | 10/1990 |
| EP | 676835 | | 10/1995 |
| EP | 860245 | | 8/1998 |
| SU | 1365207 | | 7/1988 |
| WO | WO 9319897 | A1 * | 10/1993 |
| WO | 02/38475 | | 5/2002 |

* cited by examiner 27
31
33
30
34
z
35
32
34
z
29
7
19
28
23
32
10
9
16
25
22
3
6
21
8
24
17
20
x
5
8
18
4
11
15
21
12
5
4
7
20
6
15
x
24
22
32
3
25
34
27
23
1
z
29
32
34

VIII
XIII
XII
1
2
3
4
5
7
8
9
10
12
13
14
15
16
19
22
23
24
27
29
30
31
32
33
34
35
F
x
z

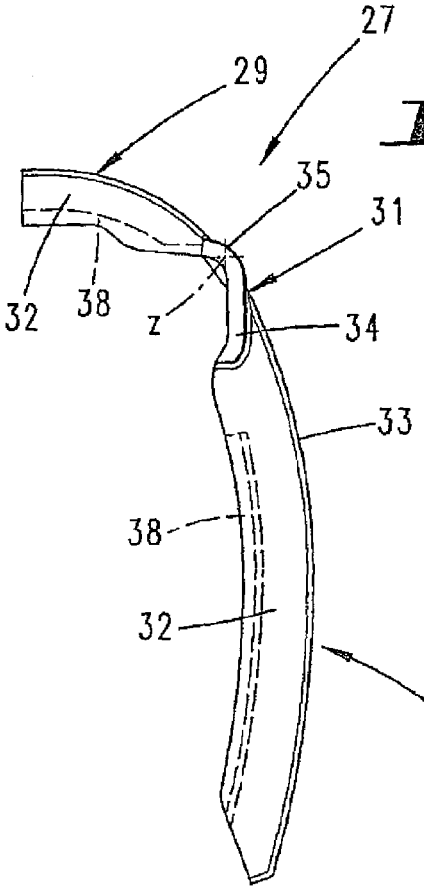
Fig. 14
Fig. 15
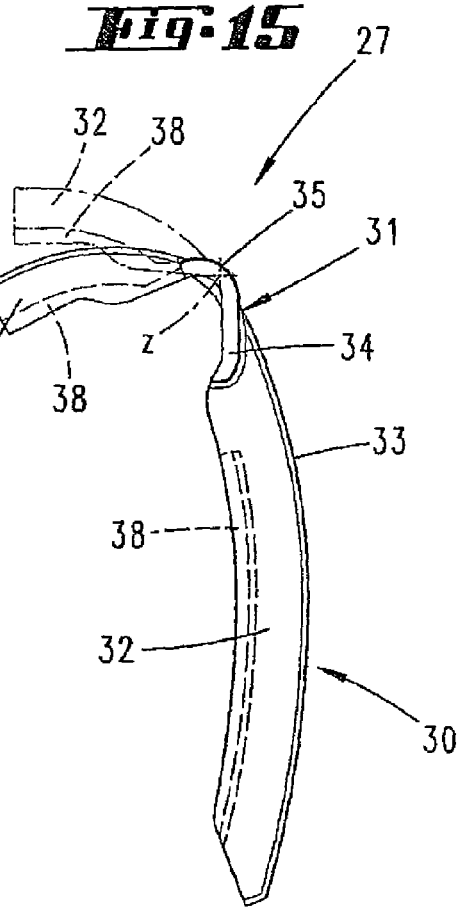

PAIR OF PRESSING JAWS FOR HYDRAULIC OR ELECTRIC PRESSING TOOL

This application is a continuation application of pending U.S. Ser. No. 11/850,504, herein incorporated by reference, filed on Sep. 5, 2007. This application claims priority from German Patent Application No. DE 202006013693.2, filed Sep. 7, 2006, herein incorporated by reference.

FIELD OF THE INVENTION

The invention relates, to a pair of pressing jaws for hydraulic or electric pressing tools for pressing fittings onto pipes or for the press connection of electric cables, the two pressing jaws being disposed for rotation about a common axis of rotation and each pressing jaw forming a bearing eye for this purpose.

BACKGROUND OF THE INVENTION

Pairs of pressing jaws of the type in question are known and are used, inter alia, for pressing fittings onto pipes, particularly in the sanitary sector. Such pairs of pressing jaws are also used for the press connection of electric cables or for pressing on cable lugs or the like. Such pairs of pressing jaws are preferably secured in a pivotable and exchangeable manner on a pressing tool.

The invention also relates to an insulating covering for a pressing jaw of a pair of pressing jaws for hydraulic or electric pressing tools for pressing fittings onto pipes for the press connection of electric cables. In particular in the case of the press connection of electric cables or the operation of pressing on cable lugs or the like, it is known to provide pressing jaws with an insulating covering. These are usually produced as plastics injection moldings, that is to say, also, for example, from polyethylene. It is further known in this respect for these insulating coverings to be secured in a releasable manner on the pressing jaws.

A pair of pressing jaws of the generic type is already known from DE 10 2005 028083 A1, the disclosure of which is incorporated herein. The accommodating opening in the pressing jaw has an opening passing through it transversely. In order to secure the tension spring, a securing part in the form of a securing pin is located in the opening. This securing pin is dimensioned to be significantly smaller than the diameter of the opening. The securing pin is accommodated loosely in the opening and has a tension-spring end engaging around it. The securing pin is retained in the opening solely by the force of the tension spring. Furthermore, reference should also be made to pressing jaws as are known, for example, from DE 203 18 618 U1.

The present invention provides a novel locking mechanism which overcomes the disadvantages presented by the prior art. Other features and advantages will become apparent upon a reading of the attached specification, in combination with a study of the drawings.

SUMMARY OF THE INVENTION

In respect of the known prior art, a technical problem of the invention is to configure a pair of pressing jaws of the type in question in a more functionally advantageous manner. A problem of configuring the pressing jaws in a more functionally advantageous manner is solved first and foremost in an embodiment of the invention, this being based on the fact that each pressing jaw forms two bearing eyes with coaxial bearing openings, and the bearing eyes are disposed in an interengaging manner in the assembled state, one bearing eye of one pressing jaw engaging between the two bearing eyes of the other pressing jaw. The pair of pressing jaws according to the invention is suitable for pressing operations in the range of from 3 to 9 tonnes of pressing force. The two pressing jaws here are disposed for rotation, in known manner, in a substantially mirror-symmetrical manner in relation to one another about the common axis of rotation, the pressing jaws, furthermore, being formed from pressing levers with one end having the pressing jaws, which form a pressing mouth in the closed position, and the ends located opposite the pressing jaws having curved tracks on which tool-mounted pressing rollers act. The pairs of pressing jaws can be pivoted in conventional manner like pliers about the axis of rotation, closure of the pressing mouth from an optionally spring-activated basic position, in which the pressing mouth is open, being made possible by means of tool-mounted pressing rollers acting simultaneously and uniformly on the curved tracks. The physical axis of rotation here is formed by a bolt or the like which passes through the bearing openings of the pressing jaws and is mounted in an accommodating neck of the pressing tool. In a development of the invention, it is provided that the bearing eyes of a pressing jaw have different thicknesses, it thus being possible, for example, for the thickness of one bearing eye to correspond approximately to twice to five times the thickness of the other bearing eye of the same pressing jaw, with the thickness measured in the direction of the axis of rotation. It is further proposed that the bearing eye of greater thickness of one pressing jaw is disposed, in the assembled state, between the bearing eye of greater thickness and the bearing eye of lesser thickness of the other pressing jaw. The clear spacing between the bearing eye of greater thickness and the bearing eye of lesser thickness of one pressing jaw thus corresponds approximately to the thickness of the thicker bearing eye. As a result, it is advantageously made possible for the pressing jaws to be configured identically to one another, which further proves to be advantageous in terms of production. Only one type of pressing jaw thus has to be produced. Two of these identical pressing jaws form a pair of pressing jaws. It is also provided that outwardly oriented stops are formed on one of the bearing eyes in order to limit the pivotability of the mounted pivoting jaw. These stops preferably interact with the pressing-tool accommodating neck, which is fixed in relation to the pressing jaws, both the open position and the closed position of the pressing mouth, furthermore, being stop-limited as a result of this configuration. The stops are preferably disposed on the outside of the bearing eye of lesser thickness. In order for the pressing jaws to be configured in a variable manner in respect of the pressing of different fittings, it is provided that the pressing jaw is formed with a mount for a pressing insert. In a further-preferred configuration, it is provided that the pressing jaws are preloaded into their open position. Correspondingly, the pair of pressing jaws, in the basic position, in which they are not subjected to loading by the pressing tool, have the pressing mouth in the open position, and can thus be applied to the pressing location without any further pivoting measure. The preloading is preferably achieved by a tension spring which is disposed so as to engage over a separating joint between the pressing jaws. For this purpose, the tension spring is secured at its ends, in each pressing jaw, in a bore which passes through the latter transversely to the direction in which the tension spring extends, thus, in particular, by means of a pin which receives the respective free end of the tension spring and is positioned in the bore which passes through the pressing jaw. The tension spring passes through the pressing jaw in the region of a further bore which extends from the narrow peripheral side directed toward the opposite pressing jaw. In particular when using the pair of pressing jaws for the press connection of electric cables, it is provided that each pressing jaw has an insulating covering on its narrow peripheral side. This insulating covering is formed as a plastics-material part which can be associated in a releasable manner with the respective pressing jaw. The insulating covering may be produced as a plastics injection molding, for example consisting of polyethylene. The significant factor here is that the insulating covering extends over the entire width of the narrow peripheral side, as measured in the direction of the thickness of the pressing jaw, and further preferably over the entire length for which this narrow peripheral edge extends. For a releasable arrangement on the pressing jaw, it is provided that the insulating covering is partly pushed on and partly clipped on. Thus, the insulating covering, in the region of the pressing-jaw mouth, can be pushed in the manner of a shoe onto the pressing-lever portion of the pressing jaw, whereas the rest of the insulating covering is clipped onto the pressing jaw in the region of the narrow peripheral side. In order to secure the insulating covering in the pushed-on state, a securing rib is provided on the pressing-mouth side of a pressing jaw, the securing rib projecting transversely to the longitudinal plane of the jaw. This securing rib is formed integrally with the pressing jaw and extends along the peripheral contour of the pressing jaw in the pressing-mouth region. It is possible to provide a securing rib associated with a broad side of the pressing jaw. An arrangement is also conceivable, while maintaining the identical configuration of the two pressing jaws, in which two securing ribs are located opposite one another. In this respect, it proves to be further advantageous that the insulating covering, with a substantially C-shaped cross-sectional configuration, has an articulation portion, as a result of which handling is simplified both when the insulating covering is disposed on the pressing jaw and when it is removed. Those regions of the insulating covering which are adjacent to the articulation portion have a substantially U-shaped cross-sectional configuration, the articulation portion being accompanied by a reduction in cross-section of the U-legs, to the extent where, in a portion which forms a geometrical articulation axis, the U-legs tend toward zero; correspondingly, only a U-crosspiece remains here. Over the longitudinal extent of the insulating portion, this U-crosspiece, which forms the geometrical articulation axis, is adjoined on both sides, in the first instance, by a portion with a U-shaped cross-sectional configuration and, thereafter, by a portion with a C-shaped cross-sectional configuration in each case. A widening of the U-crosspiece is formed in the region of the articulation portion, which widening continues, over the longitudinal extent of the insulating covering, into a rib which projects outward on the outer wall of the U-legs. When the insulating covering is applied to the pressing jaw, a securing pin for pressing inserts is associated with its articulation portion, the securing pin being provided on the pressing jaw. Correspondingly, the U-leg-free zone of the insulating covering engages around the securing pin. The articulation portion, furthermore, is formed eccentrically in relation to the longitudinal extent of the insulation covering, the articulation portion preferably being formed between the push-on portion and the clip-on portion of the insulating covering. Accordingly, in particular the application of the insulating covering to the pressing jaws is facilitated in that, in the first instance, the push-on portion is pushed onto the pressing jaw on the pressing-mouth side and, thereafter, the clip-on portion is pivoted about the articulation portion in the direction of the associated narrow peripheral side of the pressing jaw, in order finally for this portion to be clipped on. As seen in the longitudinal extent of the insulating covering, the length of the clip-on portion corresponds approximately to twice to five times, preferably three times, the length of the push-on portion. In order to secure the clip-on portion, the pressing jaw has further securing ribs which project transversely to the longitudinal plane of the jaw and run along the peripheral edge of the jaw. These securing ribs may be of cross-sectionally identical configuration to the securing ribs for forming the push-on securing means. In this respect, a securing rib disposed along the pressing-jaw peripheral contour which is directed toward the narrow peripheral side may be formed more or less continuously, optionally with an interruption in the region of the securing pin and, correspondingly, in the region of the articulation portion of the insulating covering. It is also provided that the securing pins for the pressing inserts of the two pressing jaws can be actuated in opposite directions, thus, in particular, by pressure actuation in the axial direction of the respective securing pin. The securing pins are oriented perpendicularly to a longitudinal plane of the jaws and pass through the respective pressing jaw in the region of the pressing-jaw mouth.

With respect to the insulating covering, in order to simplify the handling of such an insulating covering, in particular when it is disposed on a pressing jaw and removed therefrom, it is proposed that the insulating covering, with a substantially C-shaped cross-sectional configuration, has an articulation portion. As a result of this configuration, an insulating covering for a pressing jaw is provided, which has improved handling. The formation of the articulation portion significantly facilitates the operations both of disposing the insulating covering on the pressing jaw and of removing it therefrom. The insulating covering can be adapted more easily over its longitudinal extent, by means of the formation of the articulation portion, to the rounded outer contour of the pressing jaw, in order finally to be secured. The insulating covering has a push-on portion and a clip-on portion, the push-on portion being formed such that it is directed toward that end of the insulating covering which is to be associated with the pressing mouth. The clip-on portion, in contrast, is associated with the back of the pressing jaws. In relation to the longitudinal extent of the insulating covering, the clip-on portion has a length which corresponds approximately to twice to five times, preferably three times, the length of the push-on portion. Those regions of the insulating covering which are adjacent to the articulation portion preferably have a substantially U-shaped cross-sectional configuration, the articulation portion being accompanied by a reduction in cross-section of the U-legs. The length of the U-legs in the articulation portion tends toward zero, so that, in the region of a geometrical articulation axis, the articulation portion is preferably formed just by the U-crosspiece. A widening of the U-crosspiece is further preferably formed in the region of the articulation portion. The widening is provided on both sides, the widened portion of the U-crosspiece, running over the longitudinal extent of the insulating covering, forming an outwardly oriented crosspiece in the region of the adjacent U-legs. The articulation portion is formed eccentrically in relation to the longitudinal extent of the insulating covering, that is to say preferably between the push-on portion and the clip-on portion. In addition to the insulating action, the insulating covering may also possibly serve as rapture protection in the pressing-mouth region. The proposed articulation portion also proves to be advantageous here.

The invention further relates to a pair of pressing jaws for hydraulic or electric pressing tools for pressing fittings onto pipes or for the press connection of electric cables, two pressing jaws connected to one another in an articulated manner forming a pair of pressing jaws, the pressing jaws being biased into their open position by a tension spring, which spans a free space between the two pressing jaws, and in each case one end of the tension spring being accommodated in an accommodating opening which opens out into a narrow peripheral side of the pressing jaw, this narrow peripheral side being directed toward the free space, and, in order to secure the tension spring, a tension-spring end engaging around a pin-like securing part, which securing part is disposed at that end of the accommodating opening which is directed away from the free space.

It is an object of the invention, in the case of a pair of pressing jaws specified, to develop the means of securing the tension spring in a functionally advantageous manner. This object is achieved first and foremost in the case an embodiment of the invention, being based on the fact that the securing part is formed as an integral crosspiece of the pressing jaw.

An integrated securing part gives the advantage of it being possible for the tension spring to be connected to the pressing jaw of a pair of pressing jaws directly and without any further fastening means being used. As an integral constituent part of the pressing jaw, the securing part cannot get lost and, during assembly, fewer individual parts have to be assembled. In order to secure the tension spring, a preferably hook-like end of the tension spring engages around the crosspiece, which runs transversely to the accommodating opening. The crosspiece may run, for example, parallel to the longitudinal extent, or also in the direction of the thickness, of the pressing jaw. The crosspiece preferably has both ends connected to the pressing jaw. It is also possible for the crosspiece only to have one end fixedly connected to the pressing jaw. The securing part can be produced by casting, in conjunction with the production of the pressing jaw (for example in the lost-wax process). It is also conceivable, however, for the securing part to be produced, for example, by a metal removal operation.

Other features of the invention are described hereinbelow in relation to the subject matter of the invention described above, but may also be important in their independent formulation.

It thus appears to be advantageous for the crosspiece to be shaped out by a sunk-in region which is disposed so as to overlap an axial extension of the accommodating opening. The width of the sunk-in region preferably corresponds to the diameter of the accommodating bore and has at least a subregion overlapping the accommodating opening. With the sunk-in region being of an appropriate depth, a connecting channel can be created by the overlap between the accommodating opening and the sunk-in region. The connecting channel connects the accommodating opening to the sunk-in region and/or to the outside of the pressing jaw in this region. It is thus possible for the end of the tension spring to project into the sunk-in region from the accommodating opening. The depth of the sunk-in region here corresponds at least to the thickness of a spring wire forming the tension spring. The depth of the sunk-in region here is intended to mean the distance from the lateral surface of the accommodating opening as seen in the direction of the longitudinal axis of the accommodating opening. An absolute depth of the sunk-in region, however, should be measured from the outer surface of the pressing jaw wall in this region, that is to say it depends on the thickness of the pressing jaw wall (in this region). The given depth of the sunk-in region results in it being possible for the tension-spring end to pass through the connecting channel into the region of the sunk-in area. The sunk-in region may be of oblong configuration. The longitudinal extent of the sunk-in region here is preferably the same as the longitudinal extent of the accommodating opening.

The sunk-in region is preferably followed by a through-opening in the direction of the thickness of the pressing-jaw wall. The tension-spring end can engage into the through-opening from the sunk-in region and engage around a crosspiece, which is also formed as a result of the through-opening being made. The sunk-in region is preferably formed in, that is to say starting from, a broad side of a pressing-jaw wall. The upper side and underside of the crosspiece are not necessarily spaced apart from the longitudinal axis of the accommodating opening by the same distance. Rather, the crosspiece may be offset in the direction of a broad side of the pressing-jaw wall, as seen in relation to the longitudinal axis of the accommodating opening. However, it is also possible, in particular when sunk-in regions extend to the same depth from both broad sides of the pressing jaw wall, for the abovementioned surfaces of the crosspiece to be spaced apart from the longitudinal axis of the accommodating opening and/or from the broad sides of the pressing jaw wall by the same distance.

In relation to a surrounding peripheral region of the pressing jaw, the pressing-jaw wall is preferably recessed in the region of the sunk-in region. The pressing-jaw wall, which is thus thinner here, may be symmetrical to a plane which runs through the longitudinal axis of the accommodating opening and parallel to the longitudinal extent of the pressing jaw. This is the case when the accommodating opening is disposed centrally in relation to the two broad sides of the pressing-jaw wall (in the less thick region). The thickness of the thinner (recessed) pressing-jaw wall is less than the diameter of the accommodating opening, the thickness preferably corresponding to half to four fifths, further preferably three fifths, of the diameter of the accommodating opening. The fact that the pressing-jaw wall is thinner in relation to the diameter of the accommodating opening means that the connecting channel is created solely by the end of the accommodating opening (which is located in that very region of the thinner pressing-jaw wall).

The already mentioned crosspiece formed preferably has, on one side, a contour corresponding to the curvature of the through-opening, while the contour on the opposite side (in the region where the accommodating opening and the sunk-in region overlap) runs rectilinearly. As an alternative, it would also be conceivable for the securing part to be formed by a protuberance left in the sunk-in region. It is then possible to dispense with the through-opening. Such a protuberance extends transversely to the accommodating opening, in the direction of the thickness of the pressing jaw wall. The height of the protuberance here preferably corresponds to the absolute depth of the sunk-in region. The upper side of the protuberance thus preferably terminates with the broad side of the pressing-jaw wall. It is also possible for the protuberance to be configured such that it extends beyond the broad side of the pressing-jaw wall or also terminates some way beneath the broad side. In order to secure the tension spring, the tension-spring end engages around the protuberance.

The two pressing jaws of the pair of pressing jaws are preferably of axially symmetrical configuration. Axial symmetry is intended to mean that the two pressing jaws for a pair of pressing jaws are identical. In the assembled state, the one pressing jaw is in a state in which it has been turned through 180° about the longitudinal axis relative to the other pressing jaw.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which:

FIG. 9 is a cross-sectional view along line VII-VII in FIG. 7;

FIG. 14 is a side elevational view of an insulating covering of a pressing jaw illustrated on its own;

FIG. 15 is a side elevational view of the insulating covering of FIG. 14, but shown in a pivoted position, an end portion of the insulating covering forming a push-on portion;

DETAILED DESCRIPTION OF THE ILLUSTRATED EMBODIMENTS

Figure 1:
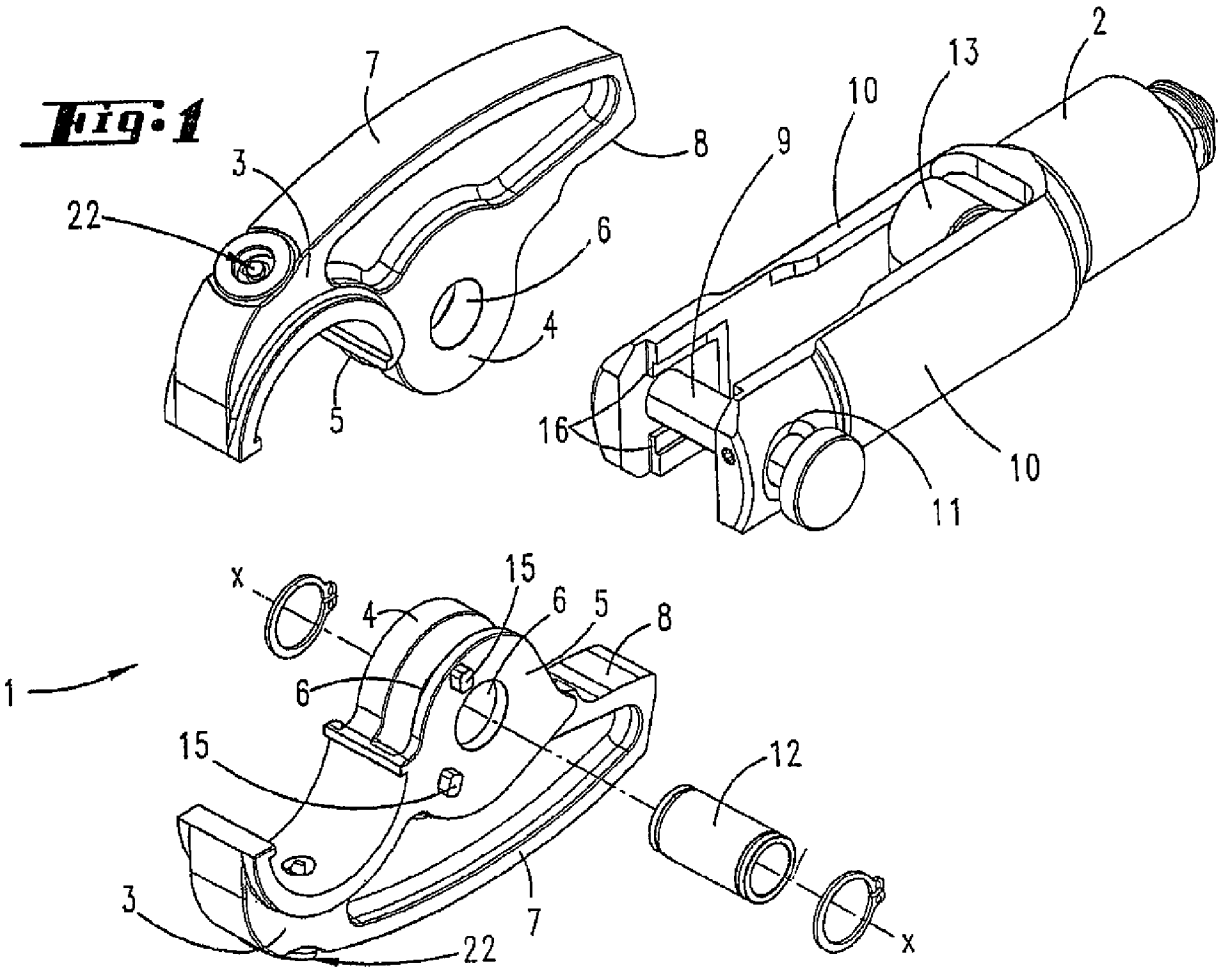
FIG. 1 is an exploded perspective view of a pair of pressing jaws according to the invention in a first embodiment, with an accommodating neck of a pressing tool.
Figure 2:
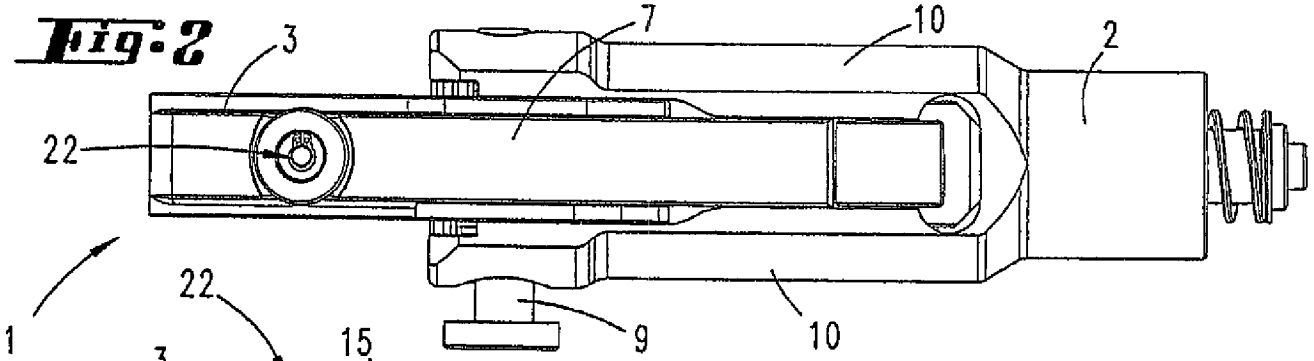
FIG. 2 is a top plan view of the pressing jaws mounted on the accommodating neck, this view relating to the open position of the pressing jaws.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein. Therefore, unless otherwise noted, features disclosed herein may be combined together to form additional combinations that were not otherwise shown for purposes of brevity.

Illustrated and described, in the first instance with reference to FIG. 1, of a pair 1 of pressing jaws, in a first embodiment, for a hydraulic or electric pressing tool, merely an accommodating neck 2 of the latter, for accommodating a pair 1 of pressing jaws, being shown in the illustrations.

The two pressing jaws 3 are configured identically to one another and each have two bearing eyes 4, 5 with coaxial bearing openings 6.

The pressing jaws 3 are part of a pressing lever 7 which, on one side of the bearing opening 6, forms the pressing jaw 3 and, on the other side of the bearing opening 6, forms a curved track 8.

The bearing eyes 4, 5 of each pressing jaw 3 have different thicknesses, as measured in the axial direction of the bearing openings. The bearing eye 4 is thus approximately three times the thickness of the bearing eye 5.

The clear distance between the two bearing eyes 4 and 5 corresponds approximately to the thickness of the thicker bearing eye 4, and is thus matched to the thickness of the bearing eye 4.

The pressing jaws 3 are oriented in relation to one another in the assembled state such that the bearing eyes 4, 5 are disposed in an interengaging manner. The thicker bearing eye 4 of one pressing jaw 3, accordingly, is disposed between the two bearing eyes 4, 5 of the other pressing jaw 3. The thinner bearing eyes 5 are thus located on the outside of the pair 1 of pressing jaws formed.

The bearing openings 6 of the two pressing jaws 3 are oriented coaxially in relation to one another and, in the assembled state, have a locking bolt 9 of the accommodating neck 2 passing through them.

The accommodating neck 2 is of conventional fork-like configuration with a bolt mount 11 in the form of a through-passage bore passing through the fork legs 10 transversely to the direction in which the neck extends. The locking bolt 9 is secured in this bolt mount 11.

The bearing eyes 4, 5 of the pressing jaws 3 extend between the fork legs 10, a sleeve 12 being positioned between the bearing openings 6 and the locking bolt 9.

The curved tracks 8 of the pressing lever 7 project into the region between the fork legs 10 of the accommodating neck 2 and, during the pressing operation, are subjected to the action of rolling bodies 13 of the pressing tool, which are displaceable, preferably hydraulically, in the direction of the curved track 8, this causing the pressing levers 7 to spread apart in the region of the curved track 8 and consequently causing the pressing mouth 14, formed by the pressing jaws 3, to close.

Figure 3:
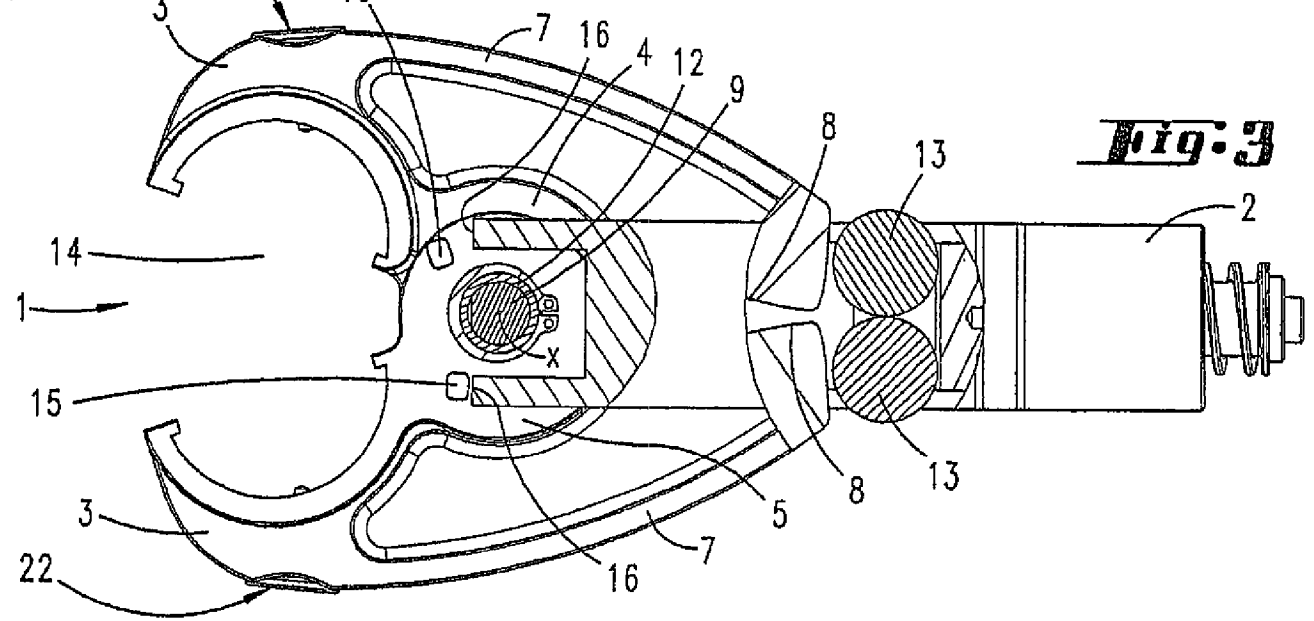
FIG. 3 is an offset longitudinal sectional view through the arrangement shown in FIG. 2.
Figure 4:
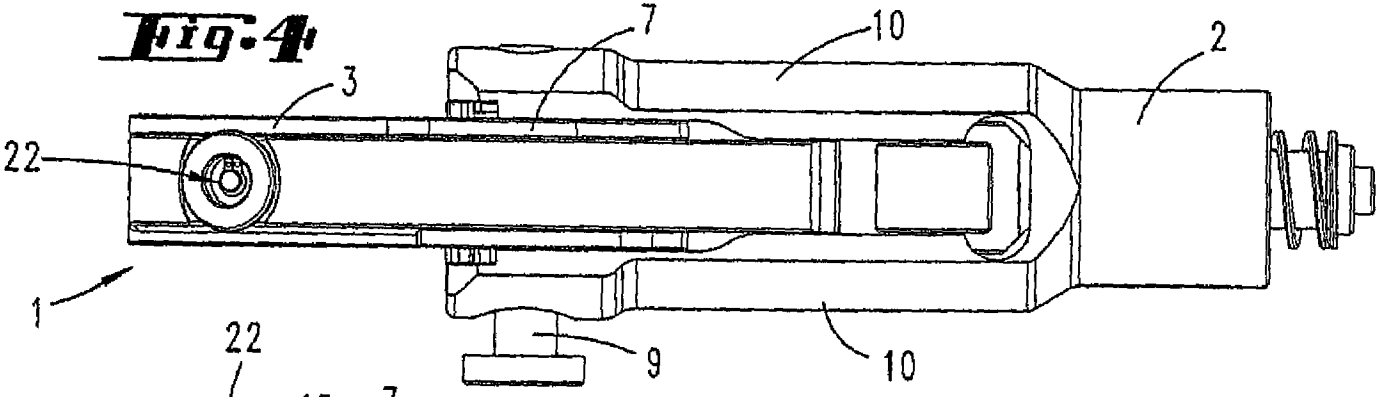
FIG. 4 is a top plan view of the pressing jaws mounted on the accommodating neck, this view relating to the closed position of the pressing jaws.
Figure 5:
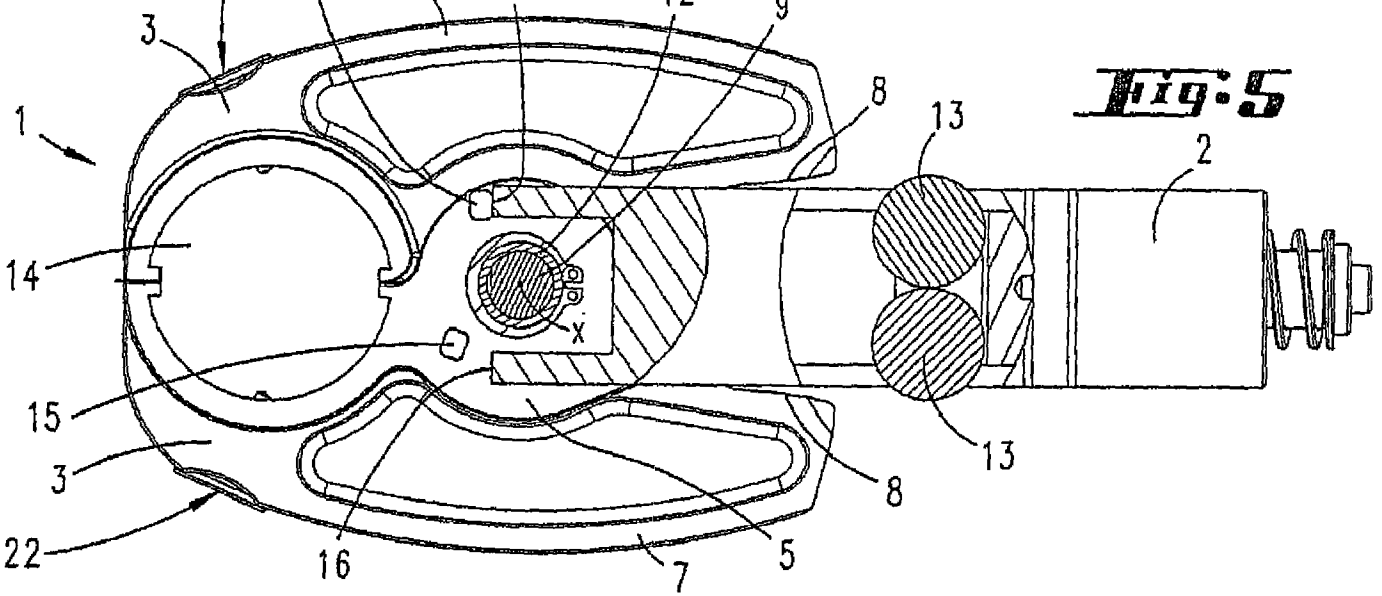
FIG. 5 is an offset longitudinal sectional view through the arrangement shown in FIG. 3.
Figure 6:
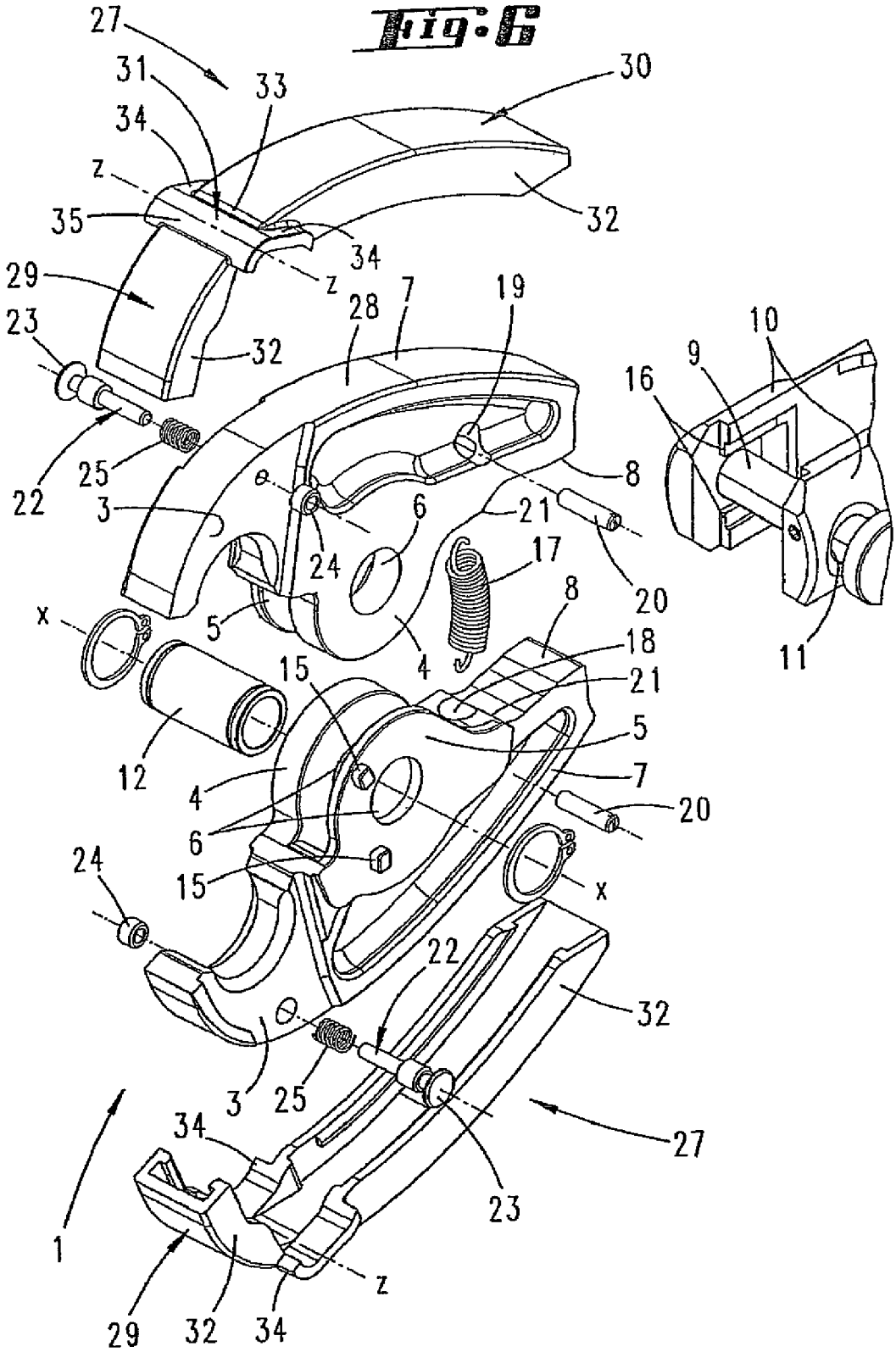
FIG. 6 is an exploded perspective view of a pair of pressing jaws according to the invention in a second embodiment, with an accommodating neck of a pressing tool.

Both the open position of the pressing mouth (see FIG. 3) and the closed position of the pressing mouth (see FIG. 5) are defined by outwardly oriented, block-like stops 15 disposed on the thinner bearing eyes 5, these stops limiting the pivotability of the mounted pressing jaws 3.

These stops 15 move over a circular path about the axis of rotation x of the pressing jaws 3 and interact with an end surface 16 of the accommodating neck 2.

The pressing jaws 3, in addition, are formed with a mount for exchangeable pressing inserts (not illustrated).

FIGS. 6 to 19 show a second embodiment, the same components, in relation to the first embodiment, having the same reference numbers.

Figures 7, 8:
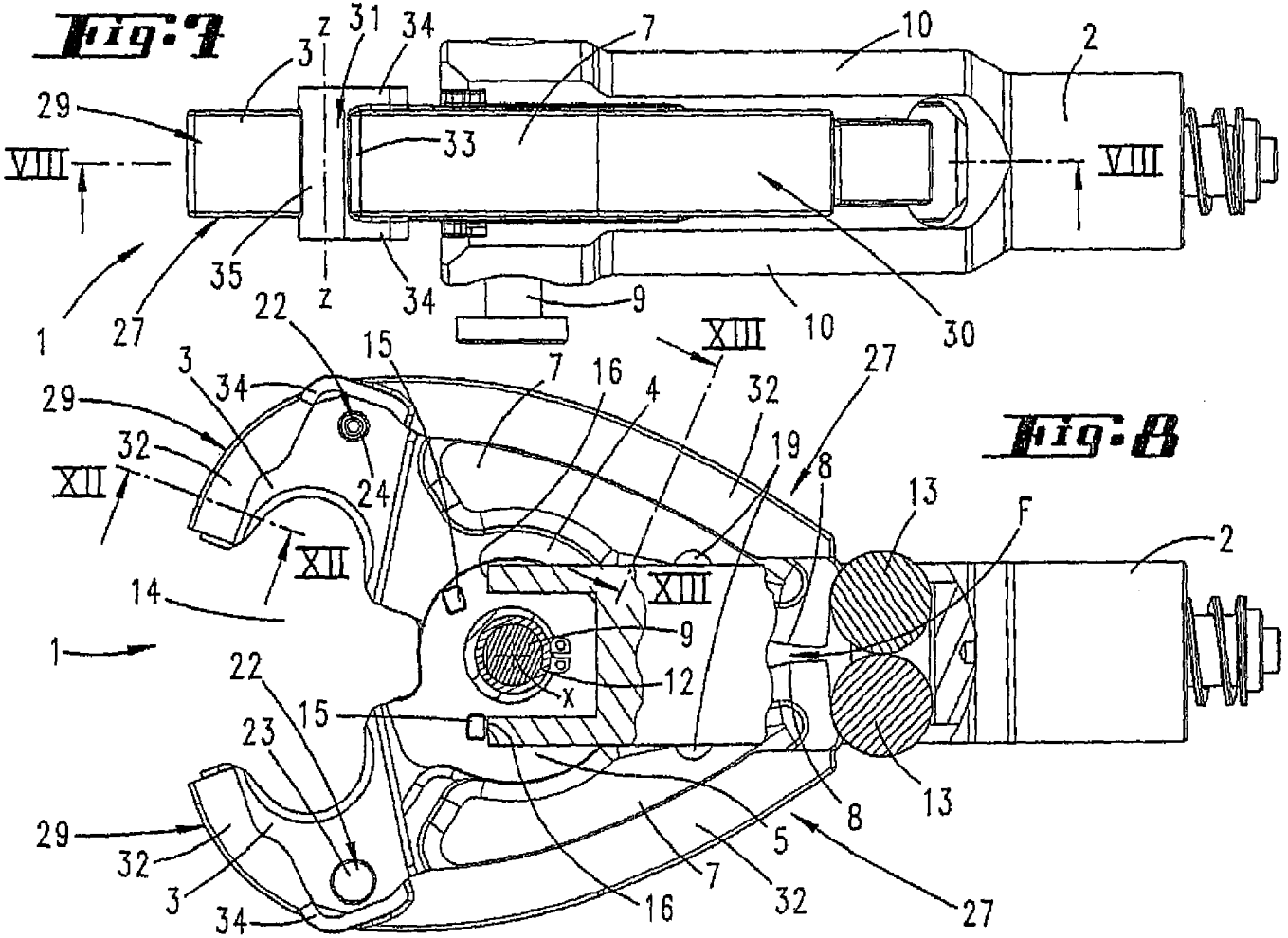
FIG. 7 is a top plan view of the pressing jaws of FIG. 6 mounted on the accommodating neck, this view relating to the open position of the pressing jaws.
FIG. 8 is an offset longitudinal sectional view through the arrangement shown in FIG. 7.
Figure 4:
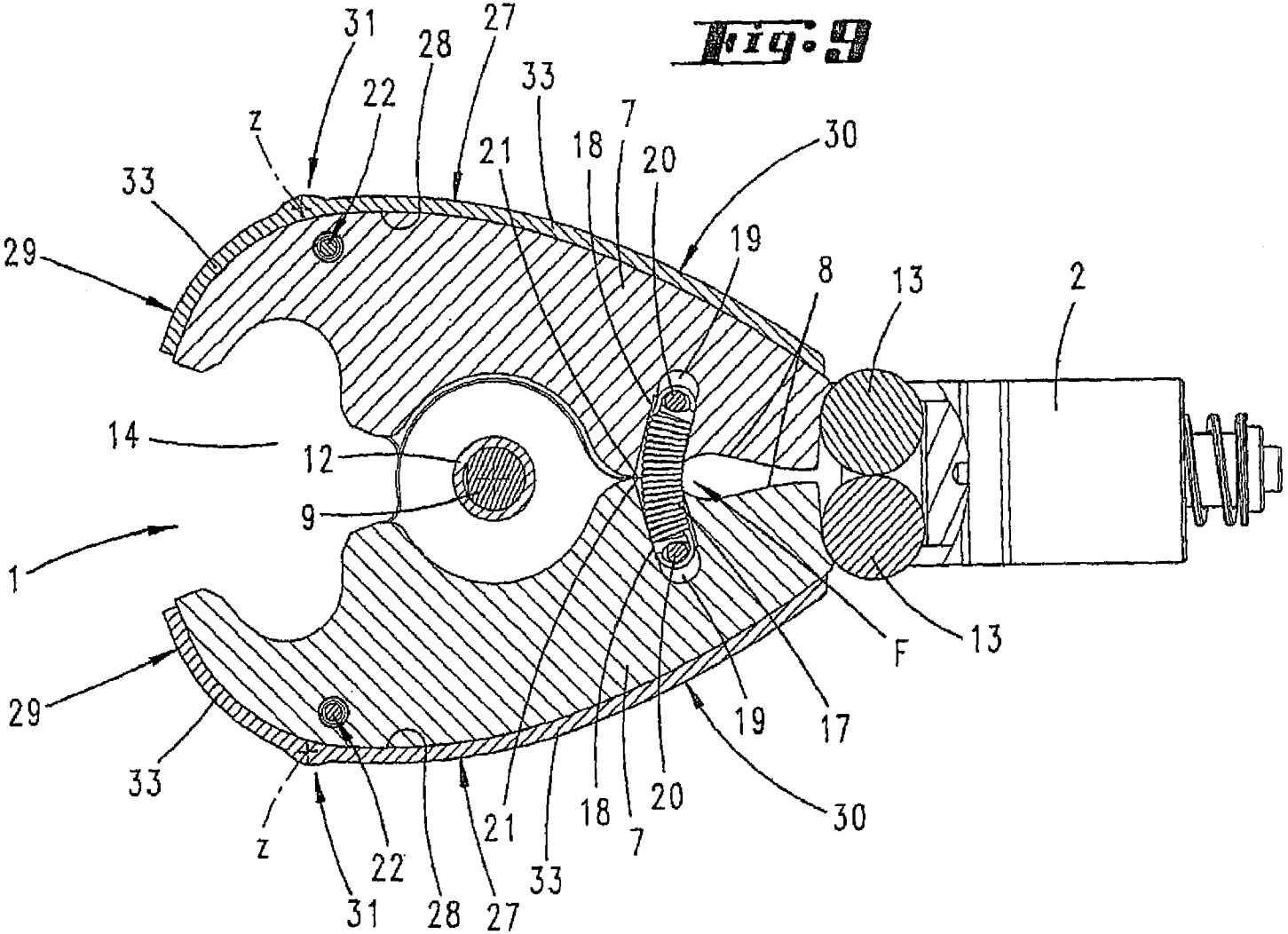

The pressing jaws 3 of the second embodiment are preloaded into their open position, which is illustrated for example in FIG. 8, a tension spring 17 being provided for this purpose. This tension spring is disposed in order to engage over the separating joint F between the pressing levers 7 of the pressing jaws 3 and is positioned, in each pressing jaw, in an accommodating bore 18 which opens out into that narrow peripheral side of the pressing jaw 3 which is directed toward the separating joint F. The two accommodating bores 18 of the pressing jaws 3 are disposed opposite one another. These accommodating bores 18 open out, at the other end, into bores 19 which pass through the pressing jaw 3, transversely to the direction in which the tension spring 17 extends, in the region of the pressing lever 7. Positioned in each of these bores 19 is a retaining pin 20 which receives the respective end of the tension spring 17 and in this respect, in interaction with the wall of the bore 19, serves as a spring anchor.

In the open position of the pressing jaws according to the illustrations in FIGS. 8 and 9, those portions of the facing narrow peripheral sides of the pressing jaws 3 which are adjacent to the accommodating bores 18 of the tension spring 17 engage against one another in a stop-limiting manner. These narrow-periphery stop regions are designated 21 in FIG. 9.

In contrast to the first exemplary embodiment, in which any pressing inserts are secured by means of securing pins 22 engaging more or less radially in the pressing mouth 14, the second exemplary embodiment provides securing pins 22 which extend parallel in space to the axis of rotation x of the pressing jaw 3 and thus parallel in space to the axis of the pressing mouth. These securing pins 22 pass through the pressing jaw 3 in the region surrounding the pressing mouth 14, the securing pin 22 being provided, at one end, with a plate-like handle grip 23 and, at the other end, that is to say on that broad side of the jaw which is located opposite the grip, with an insert-securing portion 24. The latter is of cylindrical form with a circular cross-section. By virtue of the securing pin 22 being pushed in its axial direction, the securing portion 24 is correspondingly displaced away from the broad side of the jaw, counter to the action of an interposed compression spring 25, in order to free a region of reduced cross-section. In this position, the pressing insert 26 can be removed or inserted.

It is also the case with this embodiment that the identical configuration is still ensured, this further resulting in a situation where the securing pins 22 of the two pressing jaws 3 can be actuated in opposite directions. Corresponding to a broad side of the pair 1 of pressing jaws, the grip 23 is disposed on one pressing jaw 3 and the securing portion 24 is disposed on the opposite pressing jaw 3.

For the press connection of electric cables or for pressing, for example, a cable lug onto an electric cable, it is also possible to provide insulating coverings 27 in addition to the corresponding pressing inserts 26. For this purpose, each pressing jaw 3 is assigned an insulating covering 27.

In FIGS. 14 to 19, an insulating covering 27 is illustrated in different views. The latter, in the first instance, is preferably produced as a plastics injection molding made of polyethylene or the like and has a substantially C-shaped cross-sectional configuration. Over its longitudinal extent, the insulating covering 27 is formed convexly with changing radii, as seen over its length, matched to the outer contour of a pressing jaw 3 in the region of the narrow peripheral side 28 of the latter.

As seen over its longitudinal extent, the insulating covering 27 is made up of substantially three portions: a push-on portion 29 and a clip-on portion 30 and also an articulation portion 31, which is formed between these two portions 29 and 30. The clip-on portion 30 has a length which corresponds approximately to three times the length of the push-on portion 29.

The substantially C-shaped cross-sectional configuration is interrupted in the region of the articulation portion 31. The regions which are adjacent to the articulation portion 31 on both sides, that is to say the transition regions to the push-on portion 29 and to the clip-on portion 30, have a substantially U-shaped cross-sectional configuration, the articulation portion 31 being accompanied by a reduction in cross-section of the U-legs 32. The latter tend toward zero, so that, in the region of the geometrical articulation axis z, only the U-cross-piece 33 remains. The latter is widened outward beyond the two U-legs 32. This widened portion 34 extends out of the region of the geometrical articulation axis z into the region of the adjacent U-legs 32 of the clip-on portion 30. This results—as can be seen, for example, from the illustrations in FIGS. 17 and 18—in a shield-like protective collar 35 in the region of the articulation portion 31.

In order for the insulation covering 27, which can be disposed in a releasable manner, to be secured on the associated pressing jaw 3, the latter has corresponding retaining means. Thus, each pressing jaw 3, associated with a broad side of the jaw, has a securing rib 36 which projects transversely to the longitudinal plane of the jaw and, beginning from the free end of the pressing-mouth portion of the pressing jaw 3, extends approximately into the surroundings of the associated securing pin 22. As can be gathered from the illustrations, such a securing rib 36 is only provided on one side. However, a solution with securing ribs 36 disposed on both broad sides of the jaw is also conceivable in this respect.

The securing rib 36 adjoins the contour of the narrow periphery of the pressing jaw 3, this resulting in a T-shaped configuration in cross section in the case of securing ribs 36 being formed on both sides.

Such a T-shaped cross-sectional configuration is also selected in the region of the pressing levers 7. Correspondingly, a latching rib, the cross-sectional configuration of which corresponds more or less to that of the securing rib 36, extends on both sides, that is to say on each broad side of the pressing jaw 3, along the pressing lever 7, on the far side of the securing pin 22—in relation to the pressing mouth 14. It is also possible to provide on the broad side of the pressing jaw 3, which has the securing rib 36, a rib which is continuous along the peripheral contour and is provided with a generous interruption only in the region of the securing pin 22.

The insulating coverings 27, like the pressing jaws, are of identical form.

In order to secure an insulating covering 27 on a pressing jaw 3, in the first instance the push-on portion 29 is attached on the pressing-mouth side, the securing rib 36 being gripped by the C-shaped cross-section of the push-on portion 29 during the push-on operation. The articulated arrangement of the clip-on portion 30 on the push-on portion 29 here allows straightforward handling. Finally, the clip-on portion 30 is positioned on the narrow peripheral side 28, the C-cross-pieces 38 of the clip-on portion gripping the latching ribs 37 on the pressing jaws.

Figure 11:
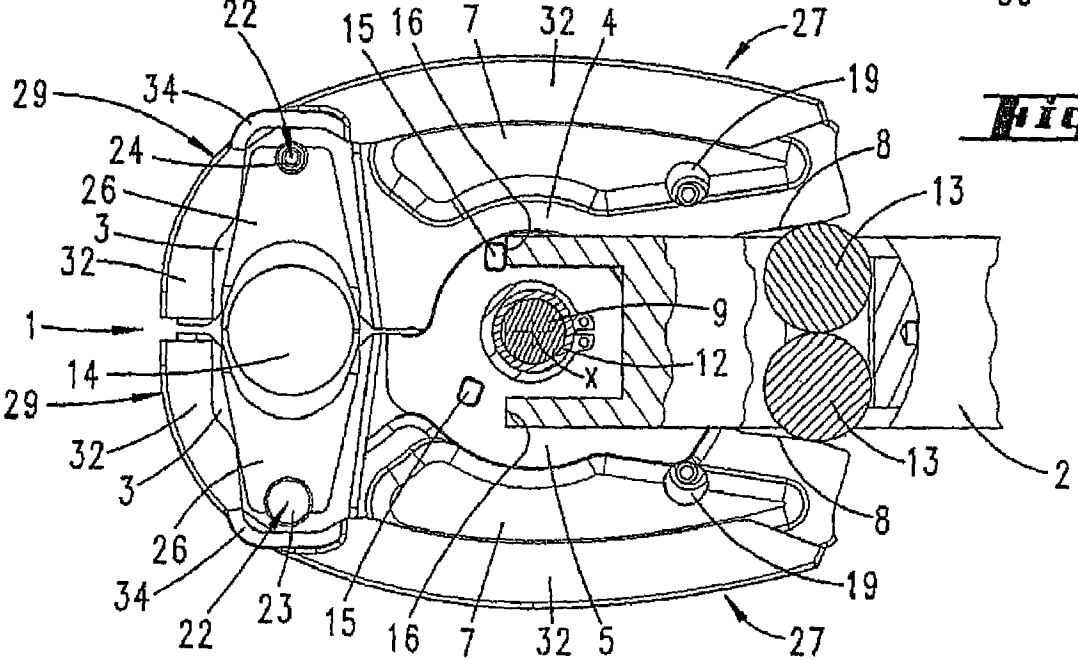
FIG. 11 is an offset longitudinal sectional view through the arrangement of FIG. 6, this view relating to the closed position of the pressing jaws.
Figure 12:
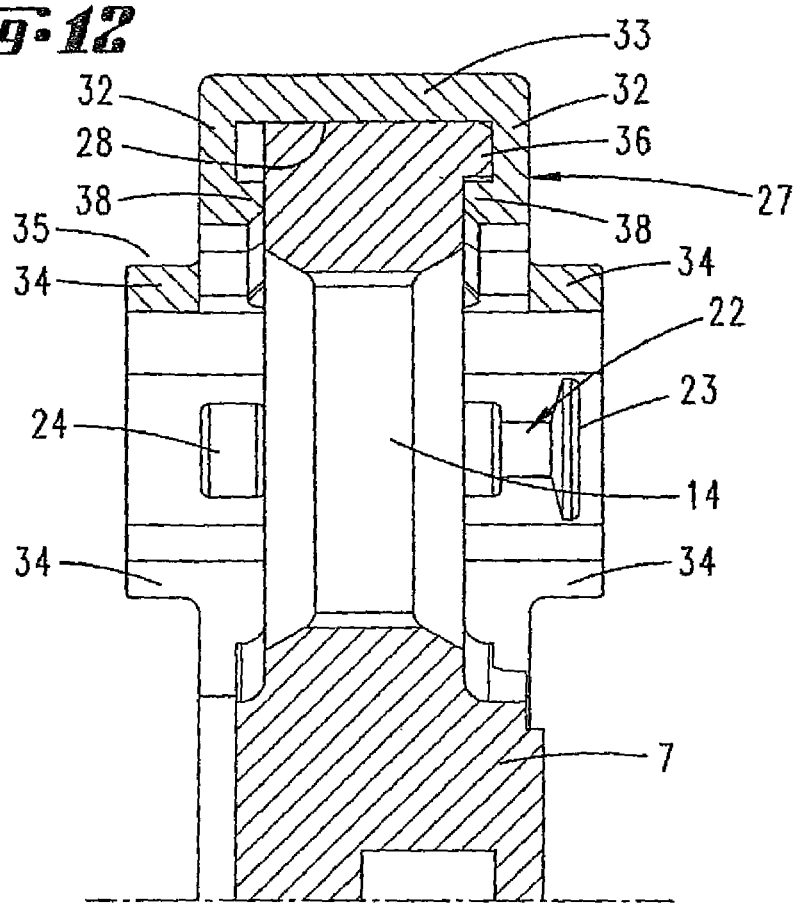
FIG. 12 is a cross-sectional view along line XII-XII in FIG. 8.
Figure 13:
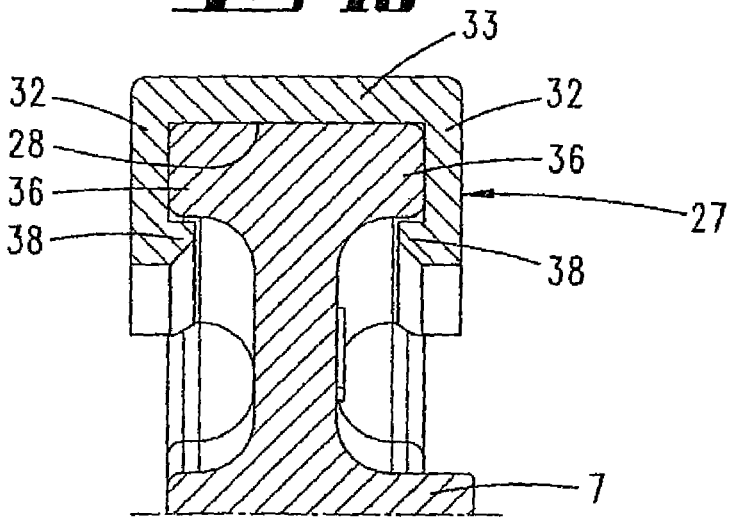
FIG. 13 is a cross-sectional view along line XIII-XIII in FIG. 8.
Figure 16:
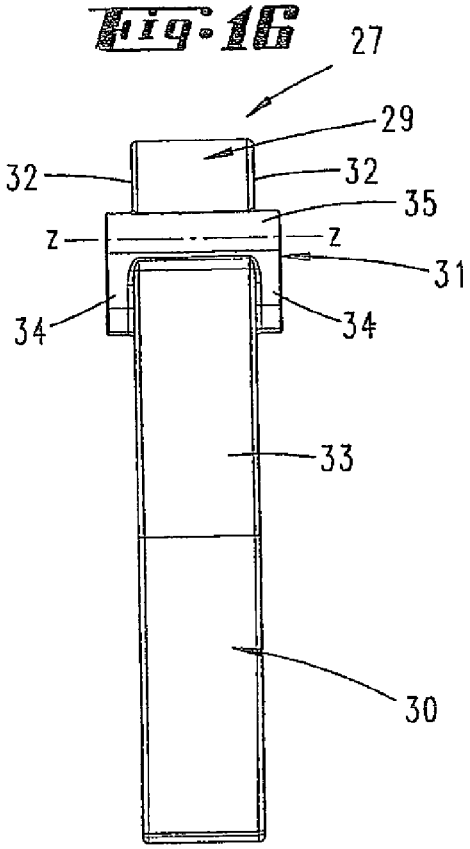
FIG. 16 is the front elevational view of the insulating covering of FIG. 14.
Figure 17:
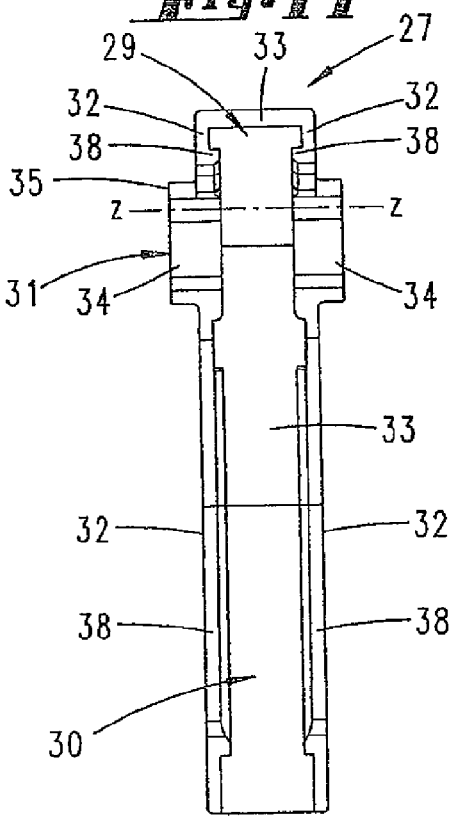
FIG. 17 is the rear elevational view of the insulating covering of FIG. 14.
Figure 18:
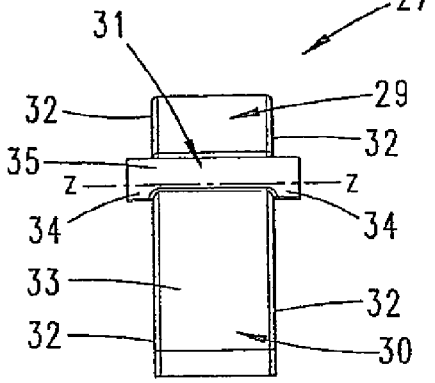
FIG. 18 is a top plan view of the insulating covering of FIG. 14.
Figure 19:
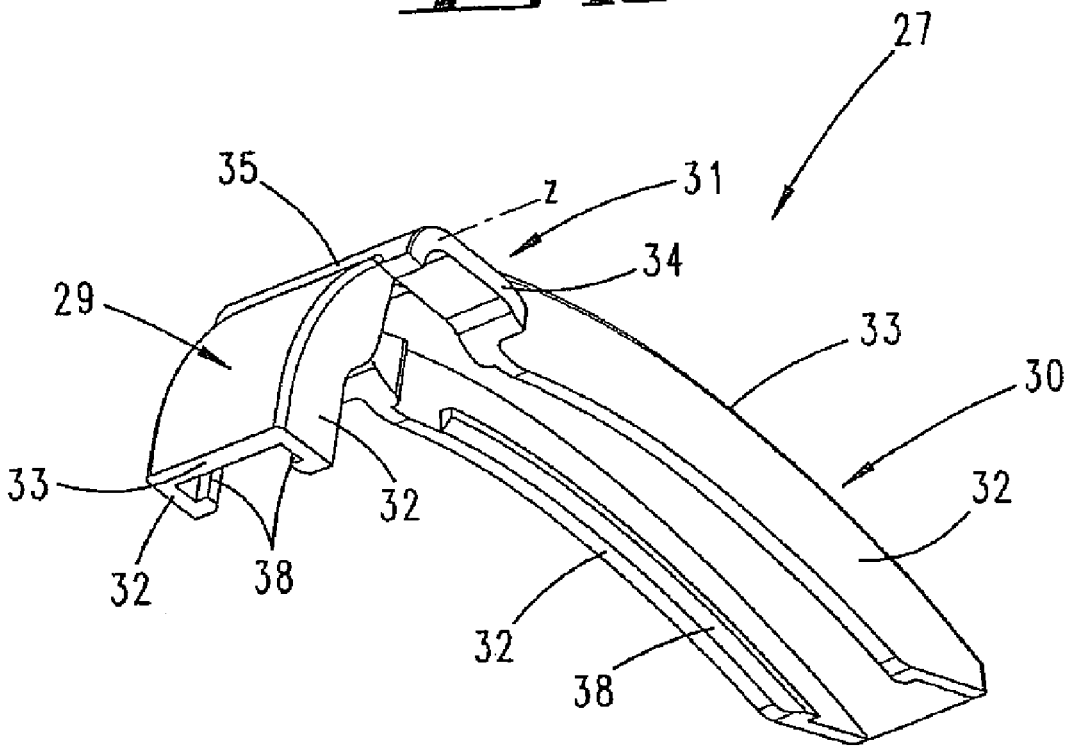
FIG. 19 is a perspective view of the insulating covering of FIG. 14.

As can be gathered from the illustrations in FIGS. 8 and 11 in particular, the articulation portions 31 of the insulating coverings 27 are associated with the respective securing pins 22 in the positions in which they are secured on the pressing jaws 3, the U-legs 32, which are interrupted in the articulation portions 31, leaving a free space for these securing pins 22.

Figure 10:
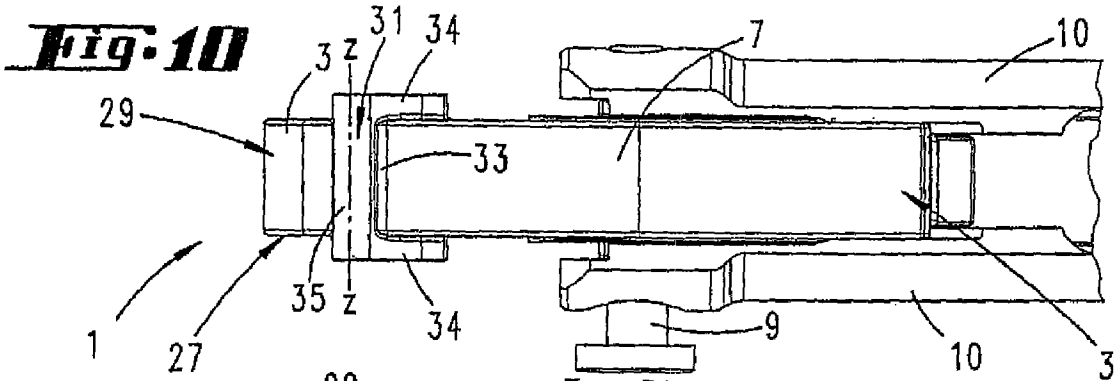
FIG. 10 is a top plan view of the pressing jaws of FIG. 6 mounted on the accommodating neck, this view relating to the closed position of the pressing jaws with pressing-mouth inserts inserted.

FIGS. 10 and 11 illustrate a closed position of the pressing mouth. This is achieved by rolling bodies 13 of the pressing tool, which can be displaced preferably hydraulically in the direction of the inner narrow peripheral sides of the pressing jaws 3, these narrow peripheral sides forming curved tracks 8, and this results in the pressing levers 7 being spread apart in the region of the curved tracks 8 and consequently in the pressing mouth 14, formed by the pressing jaws 3, being closed.

A third exemplary embodiment of a pressing jaw 101 of a pair 102 of pressing jaws will be illustrated and described with reference to FIGS. 20 to 24. The pressing jaw 101 is substantially configured as is described in FIGS. 1-19 with the exception of the differences described herein. Two pressing jaws 101 together form a pair 102 of pressing jaws. The two pressing jaws 101 are connected to one another in an articulated manner by means of a sleeve 103 (this may also be a bolt).

The pressing jaw 101 forms an accommodating opening 104 which opens out into a narrow peripheral side 105 of the pressing jaw 101, this narrow peripheral side being directed toward the free space F between the two pressing jaws 101. The accommodating opening 104 has a diameter which exceeds the thickness of the pressing-jaw wall 8 in the region of that end of the accommodating opening 104 which is directed toward the pressing-jaw interior. In the exemplary embodiment, the diameter is in the region of 8 mm. It can be seen that, rather than being a through-opening, the accommodating opening 104 terminates in the central region of the pressing jaw 101. Two broad sides 106, 107 of the pressing-jaw wall 8 each have a recessed region 109. The thickness of the pressing-jaw wall 8 in the peripheral region, that is to say outside the recessed region 109, is selected to be approximately three times the thickness in the region of a recessed region 109. In the region of a recessed region 109, 5 mm is a suitable thickness. The recessed regions 9 are set into in the pressing-jaw wall 8 from the two broad sides 106, 107 in each case.

A sunk-in region 111 is disposed in the recessed region 109 on one side, that is to say extending only from one of the broad sides. The sunk-in region 111 partially overlaps an end region (axial extension) of the accommodating opening 104. The width of the sunk-in region 111 is adapted to the diameter of the accommodating opening 104. The depth corresponds to half to three quarters, in the exemplary embodiment three fifths, of the depth of the pressing jaw wall 108 in the region of the recessed region 109. The extent of the sunk-in region 111 in the axial direction of the accommodating opening 104 corresponds approximately to double the diametral measurement of the pressing-jaw wall 108 in the region of the recessed region 109. The sunk-in region 111 here extends from a peripheral side 112 of the relatively thick periphery of the pressing-jaw wall 108, this peripheral side being directed toward the interior of the pressing jaw 101. The accommodating opening 104 itself extends axially only a little way into the region of the recessed area 9, approximately by a quarter to half of the diameter of the accommodating opening 104. Since, in relation to a center plane of the pressing jaw wall 108, the accommodating opening 104 is disposed in the region of the recessed area 9 such that it projects beyond the pressing-jaw wall 108 on both sides—in this region—a through-passage connecting channel 113 is correspondingly created. Accordingly, the connecting channel 113 connects the accommodating opening 104 and the sunk-in region 111 on one side, on the side of the sunk-in region 111.

Figure 23:
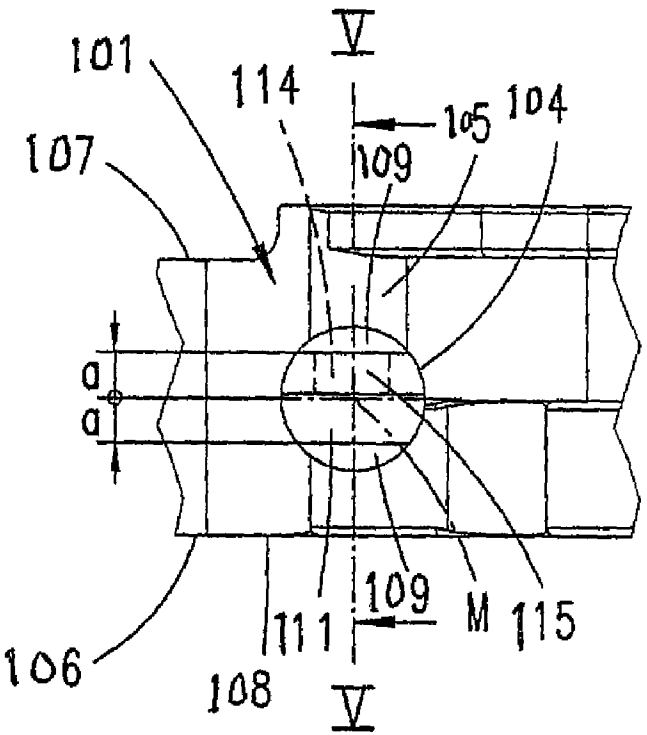
FIG. 23 is a partial plan view as seen in the viewing direction IV from FIG. 22.

As can also be gathered, in particular, from FIG. 23, the surface of the recessed region 109 runs in the manner of a secant in relation to the accommodating opening 104. It can also be seen that the surfaces of the mutually opposite recessed regions 9 of the pressing-jaw wall 108 run parallel to one another, spaced apart by the same distance a in each case from a plane running through the center point M (longitudinal axis) of the accommodating opening 104, parallel to the planar extent of the pressing-jaw wall.

The sunk-in region 111 is followed by a through-opening 114 as seen in the direction of the thickness of the pressing-jaw wall 108, the diameter of this through-opening being less than the depth of the sunk-in region 111. The pressing-jaw wall portion 108' of relatively small thickness, which is left by the sunk-in region 111, in conjunction with the through-opening 114 results in a crosspiece 115 remaining. As can also be gathered, in particular, from FIG. 24, the crosspiece 115 is offset in the thickness direction, that is to say it is associated with the broad side 7 (the broad side located opposite the sunk-in region) and, on this side, terminates with the surface of the recessed region 109.

Figure 22:
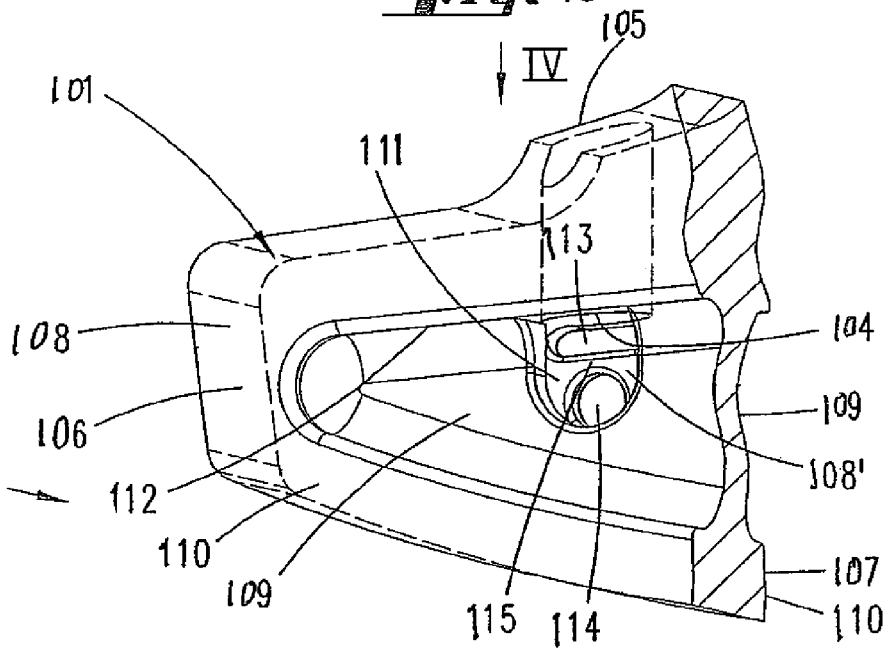
FIG. 22 is a partial view, in perspective, of a pressing jaw of FIG. 20 with a view of a securing part formed thereon.
Figure 24:
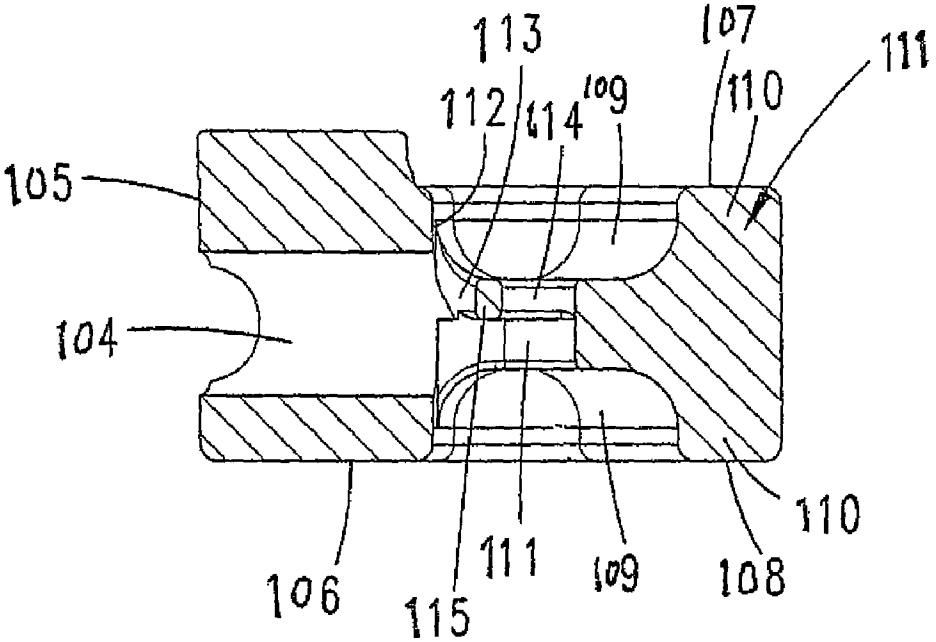
FIG. 24 is a cross-sectional view along line V-V of FIG. 23.

As can be gathered from FIG. 22 in particular, the crosspiece 115, on one side, has a contour corresponding to the through-opening 114 and, on the other side, in the region of the connecting channel 113, has an extent which runs predominantly rectilinearly.

Figure 20:
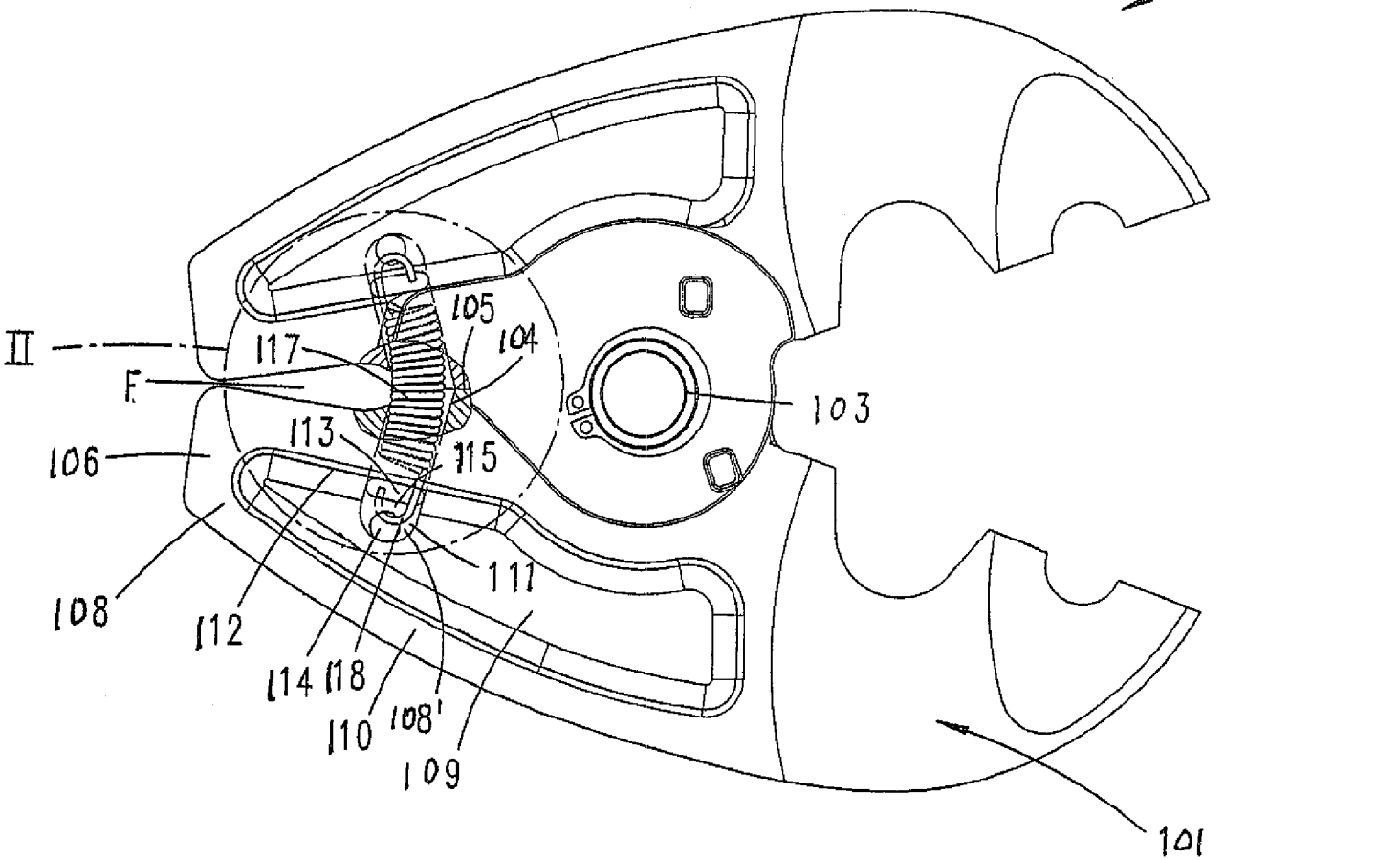
FIG. 20 is a side elevational view of a pair of pressing jaws according to the invention in a third embodiment.
Figure 21:
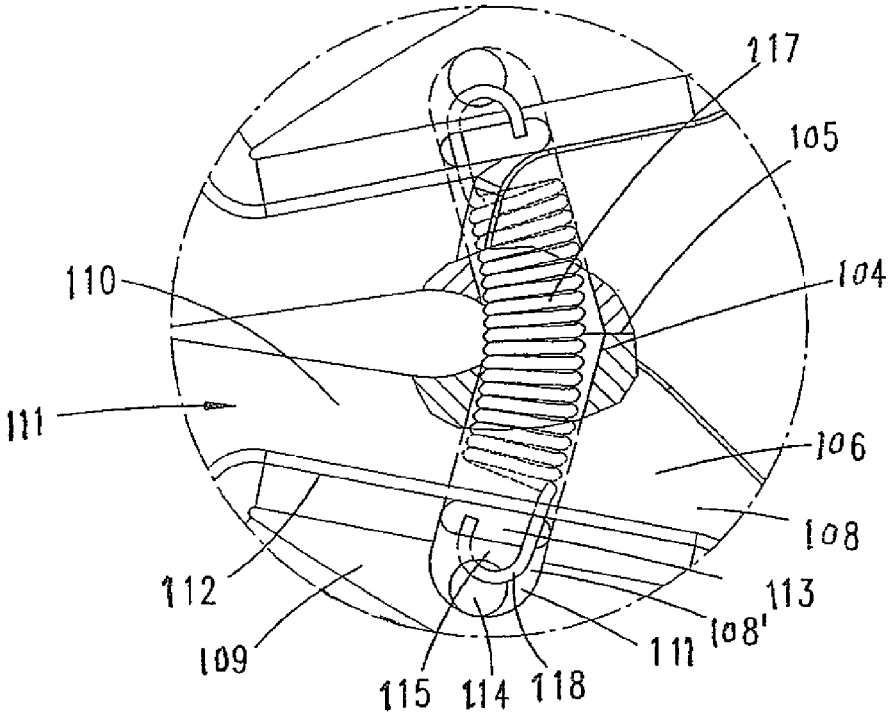
FIG. 21 is an enlarged detail corresponding to the detail II from FIG. 20.

It can be seen with reference to FIGS. 20 and 21 that in each case one end of the tension spring 117 is accommodated in an accommodating opening 104 in a pressing jaw 101. The tension spring 117 here spans the free space F between the two pressing jaws 101 of the pair 102 of pressing jaws. In order to secure the tension spring 117, a tension-spring end 118, starting from the broad side 6, engages around the crosspiece 115. The tension-spring end 118, which is associated with the interior of the pressing jaws, extends through the through-opening 114 to the broad side 7 of the pressing-jaw wall 108 and thus engages around the crosspiece 115. In the case of the embodiment which has been described up to this point, the crosspiece 115 is an integral constituent part of the pressing jaw 101. This can be realized, for example, by casting, for which purpose the lost-wax process is also suggested. The crosspiece 115 and through-opening 114 form means for securing the end of the tension spring 117 to the respective pressing jaws 101.

Figure 25:
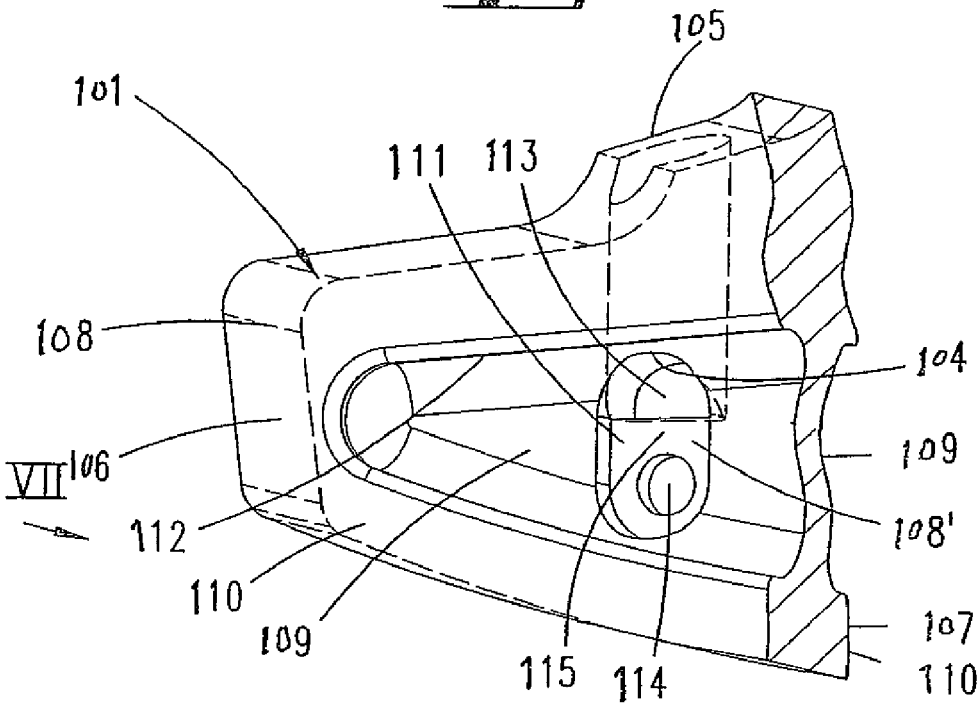
FIG. 25 is a partial perspective view of a pressing jaws according to the invention in a fourth embodiment.
Figure 26:
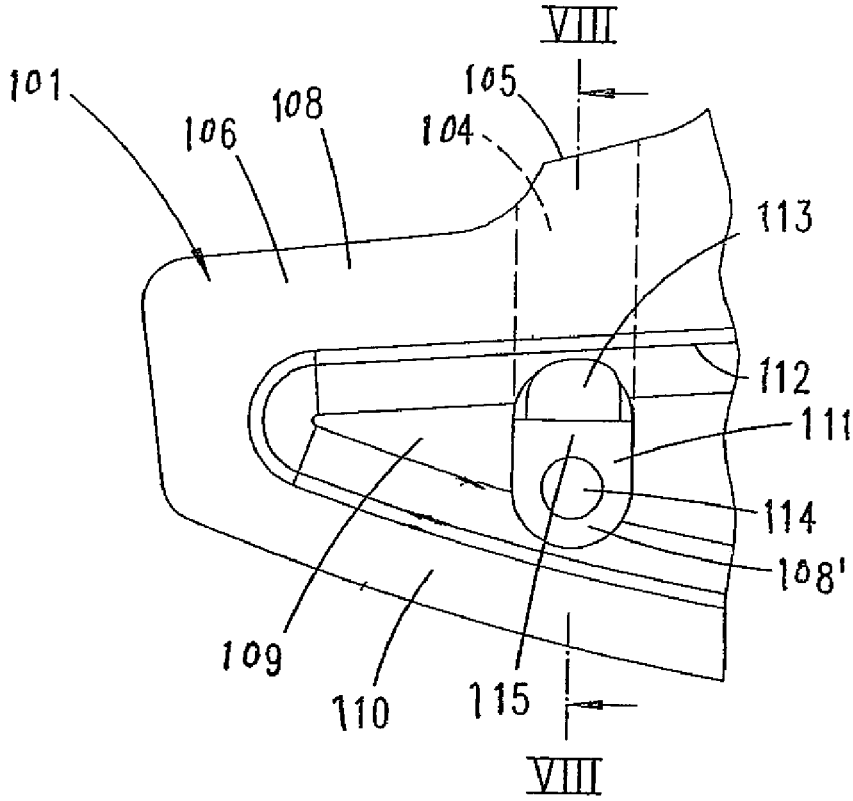
FIG. 26 is a partial side elevational view of the pressing jaw as seen in the viewing direction VII from FIG. 25.
Figure 27:
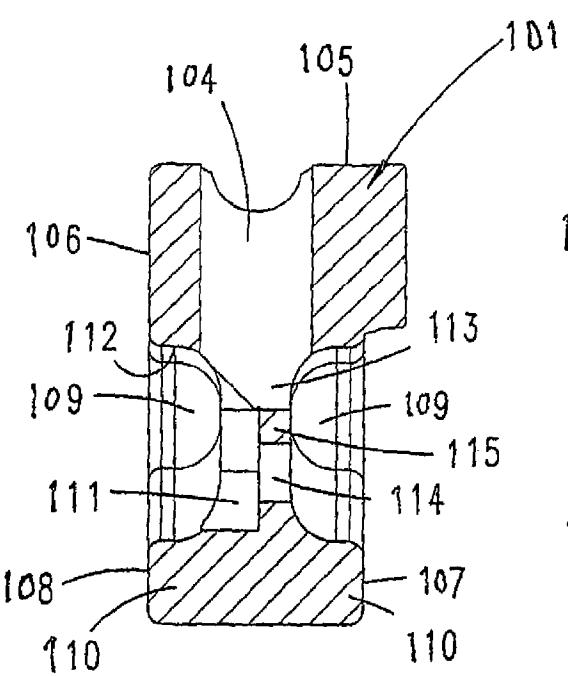
FIG. 27 a cross-sectional view along line VIII-VIII of FIG. 26.

FIGS. 25 to 27 illustrate a fourth exemplary embodiment. In particular in the case of this exemplary embodiment, the crosspiece 115 and through-opening 114 can also be produced by machining. Nevertheless, it could also be produced by casting.

In the case of this exemplary embodiment, the same elements are designated by the same reference numerals.

With reference to FIGS. 25 to 27, the recessed region 109 on the broad side 6 likewise has a sunk-in region 111. The latter is likewise disposed so as to overlap the accommodating opening 104 in the manner described. However, it is possible here for the sunk-in region 111 to start at a certain distance from the sides 112 of the recessed region 109. The accommodating opening 104 may be provided such that it runs correspondingly further into the recessed region 109, in order for the accommodating opening 104 and the sunk-in region 111 to overlap. The sunk-in region 111 may be produced, for example, by an end milling cutter.

As described previously, a connecting channel 113 is likewise produced in the region of overlap. Furthermore, a through-opening 114 is also provided in this embodiment. This through-opening 114 may be, for example, drilled. Just as in the third exemplary embodiment, this results in an integral crosspiece 115, and the crosspiece 115 and through-opening 114 form means for securing the end of the tension spring 117 to the respective pressing jaws 101.

Figure 29:
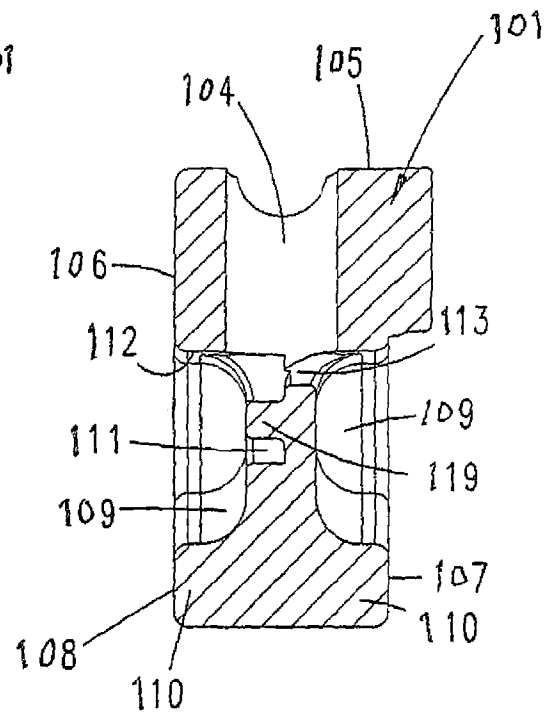
FIG. 29 is a cross-sectional along line X-X of FIG. 28.
Figure 28:
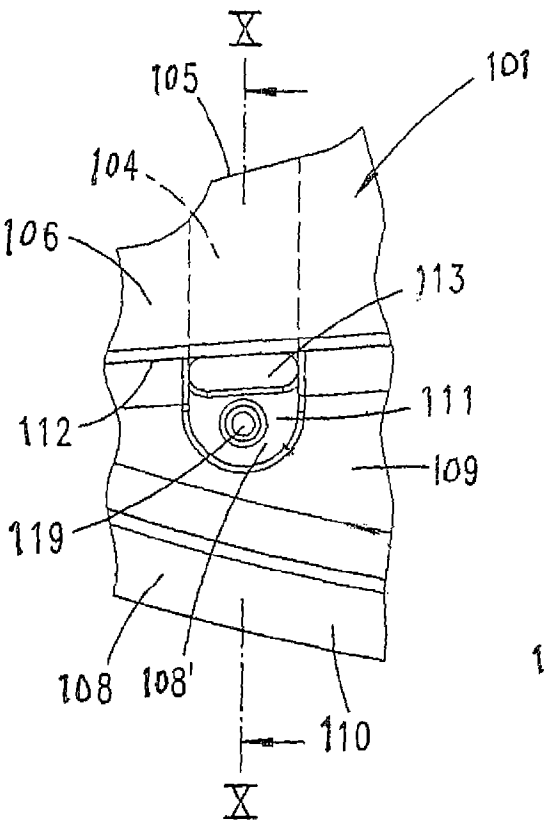
FIG. 28 is a partial side elevational view of a pressing jaws according to the invention in a fifth embodiment.

FIGS. 28 and 29 illustrate a fifth exemplary embodiment. Here too, the same elements are designated by the reference numerals which have been used above. In this exemplary embodiment, just as in the third exemplary embodiment, the crosspiece 115 and through-opening 114 are integrated by casting. However, machining would also be a conceivable production method in order to produce such an integral securing part in the form of a protuberance 119 as shown in FIGS. 28 and 29.

The fifth exemplary embodiment differs from the second and third embodiments in so far as the through-opening 114 is replaced by the protuberance 119 in the sunk-in region 111. The free end of the protuberance 119 terminates with the surface of the recessed region 109. It would also be conceivable to configure the protuberance 119 such that it goes beyond the surface of the recessed region 109. In the case of this exemplary embodiment, in order to secure the tension spring 117, the tension-spring end 118 engages around the protuberance 119. In this case, the protuberance 119 forms means for securing the end of the tension spring 117 to the respective pressing jaws 101.

All features disclosed are (in themselves) pertinent to the invention. The disclosure content, of the associated/attached priority documents (copy of the prior application) is hereby also included in full in the disclosure of the application, also for the purpose of incorporating features of these documents in claims of the present application.

While a preferred embodiment of the present invention is shown and described, it is envisioned that those skilled in the art may devise various modifications of the present invention without departing from the spirit and scope of the appended claims.

The invention claimed is:

1. Pair of pressing levers for hydraulic or electric pressing tools for pressing fittings onto pipes or for the press connection of electric cables, comprising:

two pressing jaws, each said pressing jaw having a first jaw end and a second jaw end, said pressing jaws capable of being in an open position wherein said first jaw ends are spaced apart from each other and said pressing jaws capable of being in a closed position wherein said first jaw ends are proximate to each other;

an extension extending from said second end of each said pressing jaw, each said extension having a first extension end and a second extension end, wherein said first extension ends are proximate to each other when said pressing jaws are in the open position and said first extension ends are spaced apart from each other when said pressing jaws are in the closed position, each said extension having opposite side walls extending between said first and second extension ends;

an articulation between said pressing jaws and said extensions, said pressing jaws being connected to one another in an articulated manner at an said articulation;

an accommodating bore formed through each said extension, each said bore being formed of a side wall formed by said respective extension, a first end opening out into said first extension side of said respective extension and a second opposite end spaced from said first extension side of said respective extension;

a sunk-in region formed in one of said side walls of each said extension at said second end of said accommodating bore;

a tension spring having opposite ends, said tension spring biasing the pressing jaws into said open position, said tension spring extending between the extensions;

means for securing an end of said tension spring to said extensions, said means for securing being integral with each said extension and disposed in said sunk-in region, wherein portions of said tension spring seats within said accommodating bore of each said extension such that said wall of said accommodating bores completely surrounds said portions, and the respective end of the tension spring engages said means for securing.

2. Pair of pressing levers according to claim 1, wherein said means for securing in each said extension comprises a through-opening.

3. Pair of pressing levers according to claim 1, wherein in each said extension the sunk-in region is formed in a wall which is perpendicular to the first side.

4. Pair of pressing levers according to claim 1, wherein said tension spring is formed of a spring wire having a thickness, and each said sunk-in region has a depth which corresponds at least to the thickness of the spring wire.

5. Pair of pressing levers according to claim 2, wherein said through-opening has a curvature, said means for securing further comprises a crosspiece proximate to each said through-opening, each said crosspiece having opposite sides, one of said sides having a contour corresponding to the curvature of the respective through-opening.

6. Pair of pressing levers according to claim 1, wherein said means for securing comprises a protuberance.

7. Pair of pressing levers according to claim 6, wherein a height of each said protuberance corresponds to a depth of the respective sunk-in region.

8. Pair of pressing levers according to claim 1, wherein the two pressing jaws are axially symmetrical.

9. Pair of pressing levers according to claim 1, wherein the two pressing jaws are mirror-symmetrical.

* * * * *